US006736341B2

(12) United States Patent
Lind

(10) Patent No.: US 6,736,341 B2
(45) Date of Patent: May 18, 2004

(54) NOZZLE FOR AN AIR SUPPLY DEVICE AND AN AIR SUPPLY DEVICE HAVING ONE OR MORE SUCH NOZZLES

(76) Inventor: Leif Lind, Burevägen 5, Djursholm (SE), SE-182 63

( * ) Notice: Subject to any disclaimer, the term of this patent is extended or adjusted under 35 U.S.C. 154(b) by 0 days.

(21) Appl. No.: 10/149,610

(22) PCT Filed: Dec. 20, 2000

(86) PCT No.: PCT/SE00/02598

§ 371 (c)(1),
(2), (4) Date: Jun. 14, 2002

(87) PCT Pub. No.: WO01/46624

PCT Pub. Date: Jun. 28, 2001

(65) Prior Publication Data

US 2002/0179749 A1 Dec. 5, 2002

(30) Foreign Application Priority Data

Dec. 21, 1999 (SE) ..... 9904694

(51) Int. Cl.[7] ..... B05B 15/08

(52) U.S. Cl. ..... 239/587.1; 239/587.5; 239/589; 239/590

(58) Field of Search ..... 239/589, 590, 239/590.3, 590.5, 587.1, 587.2, 587.5, 539, 541, 581.2; 454/154–5, 286, 318, 313

(56) References Cited

U.S. PATENT DOCUMENTS

| | | | | | |
|---|---|---|---|---|---|
| 3,103,155 | A | * | 9/1963 | Boylan et al. | 454/154 |
| 3,276,347 | A | * | 10/1966 | Atkinson et al. | 454/154 |
| 3,814,001 | A | * | 6/1974 | Hill | 454/154 |
| 4,316,406 | A | | 2/1982 | Lind | |
| 4,699,322 | A | * | 10/1987 | Jobst | 239/503 |
| 4,848,669 | A | | 7/1989 | George | |
| 5,733,189 | A | * | 3/1998 | Eastwood | 454/155 |
| 6,019,676 | A | * | 2/2000 | Kim | 454/155 |
| 6,135,877 | A | | 10/2000 | Lind | |
| 6,342,003 | B1 | * | 1/2002 | Wang | 454/155 |

FOREIGN PATENT DOCUMENTS

| | | |
|---|---|---|
| DE | 888308 C | 8/1953 |
| DE | 34 15 370 A1 | 11/1985 |
| EP | 0507756 A1 | 10/1992 |
| GB | 571761 A | 9/1945 |
| SE | 511340 C2 | 9/1999 |

* cited by examiner

*Primary Examiner*—Henry Bennett
*Assistant Examiner*—Amanda Flynn
(74) *Attorney, Agent, or Firm*—Sughrue Mion, PLLC

(57) ABSTRACT

A nozzle of an air supply device is accommodated in a hole (17) in a wall (15) of the device, such as to enable the nozzle to be rotated about a first axis extending through the center of the hole, and pivoted about a second axis that extends perpendicularly to the first axis through two engagement points (6*a*) on the nozzle. The nozzle includes two or more guide vanes or baffles in the form of tongues (2,3) that have rear deflecting parts (2*a*,3*a*) of mutually different curvature, and a front, generally flat outflow part (2*b*,3*b*). The nozzle also includes a central tongue-holding part (5) which has resilient hook-shaped engagement elements (6*a*) at opposite ends. The nozzle may also include a third guide vane or baffle (4) that lacks a curved deflecting part. The air flow exiting from the nozzle can be directed in different planes. The invention also relates to an air supply device provided with one or more such nozzles (1).

8 Claims, 1 Drawing Sheet

NOZZLE FOR AN AIR SUPPLY DEVICE AND AN AIR SUPPLY DEVICE HAVING ONE OR MORE SUCH NOZZLES

FIELD OF INVENTION

The present invention relates to a nozzle for an air supply device for capturing and deflecting an air flow passing through the device, and more particularly to a nozzle of the kind defined in the preamble of Claim 1. The invention also relates to an air supply device provided with one or more such nozzles.

Nozzle-equipped air supply terminal devices of the kind concerned in this document, e.g. devices marketed under the trade name REPUS®, find versatile use for the draught-free supply of attemperated air to different types of locales, including offices and living accommodations. The air blown into the locale from device has a low impulse and the device can therefore often be placed in the immediate vicinity of a working place and therewith ensure that the air present therein will be of a much better quality than would otherwise have been the case.

When cooled air is delivered to an air supply terminal device of the aforesaid kind, it is preferred to mix air from the occupied zone of the room in question with the cooled air in suitable proportions, which is expedient in avoiding cold draughts in the proximity of the floor of the room.

DESCRIPTION OF THE BACKGROUND ART

The air jets or nozzles used in such air supply devices for capturing and deflecting air flowing through the device in a main stream direction are either fixed or moveable, e.g. rotatably mounted in a wall of the device and normally including one or more tongues which form guide vanes or baffles and which project into the air flow and therewith deflect the same.

The wall that is equipped with one or more nozzles may be mounted within the device, although the nozzle or nozzles may, alternatively, be disposed in the outer wall of said device. In this latter case, device may have the form of an air supply duct, e.g. in classrooms, for equalizing the temperature gradient in storage locales or for defrosting windows.

The nozzles may be round and divided into chambers by partition walls which, for instance, define angles of 120° therebetween. The tongue or tongues projecting into the air flow may have mutually different lengths.

Alternatively, the nozzles may have a generally rectangular shape with one or more curved tongues or baffles, in which case the nozzles are normally fixedly mounted.

SE-C-9600939-4 (Publication No. 508 846) (Lind) describes an air supply device in the shape of a box or a screen that includes a front wall which has disposed therein groups of slots where the groups of slots and the slots in each group are mutually equidistant. Each group of slots is provided on the inside of the wall with a nozzle module in which the number of nozzles equals the number of slots and where said nozzles are intended to deflect sub-flows repeatedly from a supplied main flow through an angle of 90°. Each nozzle is provided to this end with curved deflecting parts which project progressively further out in the direction of the main flow. The deflected sub-flows collide and exit outwardly through the slots associated with respective nozzles with a low impulse.

EP-B1-0 507 756 (Stifab) describes an air supply terminal device which comprises a distribution plate that includes a plurality of circular openings that accommodate nozzles provided with deflecting elements in the form of guide vanes or baffles that project out beyond the plane of the plate. The nozzles are mounted in the hole for both rotatable and pivotal movement, so that in one nozzle position the exiting air flow will be directed upwards and in another position will be directed horizontally.

SE-C-9600635-1 (Publication No. 511 340) (Stifab Farex) describes a further development thereof, in which the rotatable nozzles are set in different positions such that the exiting air will be caused to rotate resulting in high entrained ejection of room air.

Although these known nozzle designs—which have the characteristic features set forth in the preamble of Claim 1—enable an adjustable near zone to be achieved for directing the flow of exiting air in a desired direction, they are unable to produce uniform flow distribution. This is due, among other things, to the fact that all the tongues or baffles of the nozzle have the same shape, meaning that at least a part of the tongues will not follow the flow lines of the air.

This also applies to the nozzle described in DE 888 308 (Fourtier), which lacks outwardly projecting, curved deflecting parts on the guide vanes.

Other drawbacks with known nozzles are that such nozzles have a limited directional effect, that they can only be accommodated in a flat plate provided with holes for accommodating respective nozzles, and are expensive to produce as a result of being comparatively material consuming.

OBJECTS OF THE INVENTION

With a starting point from the aforesaid, an object of the present invention is to provide a nozzle of the aforedescribed kind that has uniform flow distribution and which allow the exiting air flow to be directed in several different planes.

Another object is to provide a nozzle which, as a result of said uniform flow distribution, enables low sound generation to be achieved and which is also inexpensive to produce. owing to the material-saving design of the nozzle.

A further object of the invention is to provide a nozzle that can be accommodated in a perforated wall of an air supply terminal device, wherein the wall may be either planar or curved to some degree without influencing the intended function of the nozzle.

Yet another object of the invention is to provide a nozzle that can be readily mounted and that can be releasably fixated in desired positions, i.e. so as to enable adjustments to be easily made when necessary.

SUMMARY OF THE INVENTION

These and other objects are fulfilled by an inventive nozzle of the kind earlier described and having the characteristic features set forth in the characterizing clause of claim 1.

Because the nozzle can be swung about a pivot axis that is perpendicular to the rotational or turning axis of the nozzle, regardless of the position to which the nozzle has been turned, the nozzle will enable the exiting flow to be directed in several different planes, therewith providing considerable improvement with respect to nozzle properties. Consequently, the nozzle can be used in several different types of air supply terminal devices with improved control possibilities.

In practice, the nozzle is suitably provided with a central tongue-holding part which extends perpendicularly to the plane of the outflow parts, and two opposing attachment elements for engagement with opposing parts of the edge surrounding the hole.

In other words, the nozzle is pivotal about said second axis, which may fall in the plane of the hole or in a plane parallel with the hole-plane.

A simple and reliable construction is obtained therewith, provided that the attachment elements are so constructed as to allow pivoting of the nozzle from a starting position through an angle of at least 30°, suitably at least 45° and preferably at least 60°, in both directions, regardless of the position of rotation of the nozzles. A Coanda effect will occur at larger pivot angles and therewith cause will cause the air flow to adhere to the wall of the device in which the nozzle is mounted.

In one preferred embodiment, the attachment elements include hook elements that springingly engage the circumferential edge of the hole.

Such attachment elements enhances the use possibilities and flexibility of the nozzle. For example, the same nozzle can be used in holes that are not fully round and, for instance, have an oval shape and also in air supply terminal devices that have curved walls such that the hole provided in said wall will not lie in a unitary plane. The statement to the effect that the nozzle can be rotated or turned about "an axis passing through the center of the hole generally at right angles to the plane of said hole" is intended to cover the case when the wall surrounding said hole is curved.

The nozzle construction becomes particularly simple and expedient when the opposing hook elements are joined to the central holder part of the tongues and are located in the same plane as said part. The hook elements may therewith be integral with said holder part and project resiliently therefrom.

In a further embodiment, the nozzle includes two circular or approximately circular side walls parallel with the central holder part and at mutually the same distance therefrom, each of said side walls being joined to the tongues in the region of their outer ends.

These sides contribute towards stiffening the nozzle construction, so as to obviate the need of a surrounding casing—which represents a significant saving in material. At the same time, the nozzle will lack pockets and similar areas in which dirt, dust, etc., can collect. Instead, all parts of the nozzle are easily reached, e g. for cleaning purposes, therewith improving the hygienic properties of the nozzle.

The outside of the side walls may include centrally positioned arcuate and possibly saw tooth-configured hole-engaging parts that extend out perpendicularly to the side walls and that function to releasably fixate the nozzle in its rotational and pivotal positions. These structural features of the inventive nozzle also contribute towards its simplicity and reliability. Each side wall may include one, two or more such engagement parts.

If, as in accordance with one preferred embodiment, the curved parts of the tongues have mutually different radii, there is obtained an embodiment in which the shape of the tongues or guide vanes follows the lines of the air flow, therewith contributing towards the desired uniform flow distribution and reducing the nozzle noise.

In the case of an embodiment preferred in practice, the nozzle has three tongues, of which the third tongue or the last tongue in the direction of the main air flow lacks a curved deflecting part. Practical trials have shown that a nozzle of this design obtains optimal properties adapted to air deflection in different planes afforded by the nozzle.

It is preferred that the distances between the engagement points of the diametrically opposed hook elements and the outer points of the arcuate hole-engaging parts in their respective positions of engagement essentially correspond to one another and to the diameter of the hole. However, said distances may conveniently slightly exceed the diameter of the hole. The aforementioned outer points can therewith be said to be located on the cylindrical surface of an imaginary sphere surrounding the nozzle, the diameter of said sphere corresponding to the diameter of said hole.

It will be evident from the aforegoing that the nozzle can be fitted into the hole and removed therefrom quite easily, and that the position of the nozzle can be readily adjusted to obtain a desired flow pattern. The resilient attachment of the nozzle contributes towards the simplicity of these latter operations.

The invention also relates to an air supply terminal device of box-like, screen-like or tubular configuration, comprising a body that includes a top and a bottom wall and one or more outer and/or inner walls extending between said top and bottom walls, and means for supplying an air flow in a main flow direction parallel with one of said walls, wherein said device is characterised in that said wall includes one or more holes in which a nozzle of the aforesaid kind is accommodated.

Further characteristics of and advantages afforded by the invention will be apparent from the following description of a preferred embodiment of the invention. The description is made with reference to the accompanying drawings, in which FIG. 1 is a perspective view of an inventive nozzle;

DETAILED DESCRIPTION OF A PREFERRED EMBODIMENT

Figure 1:
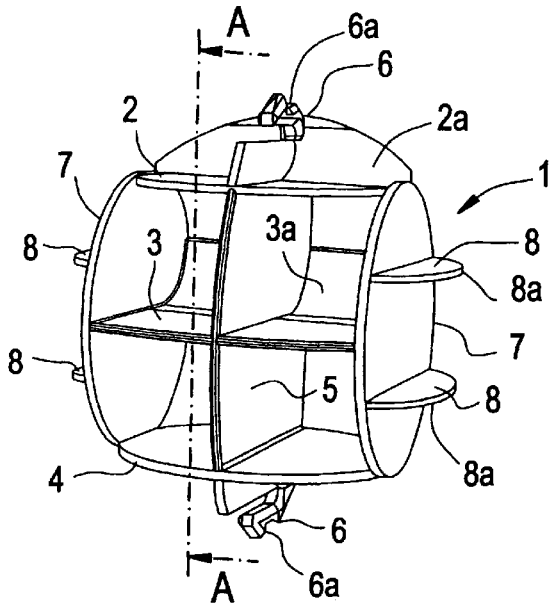
Figure 2:
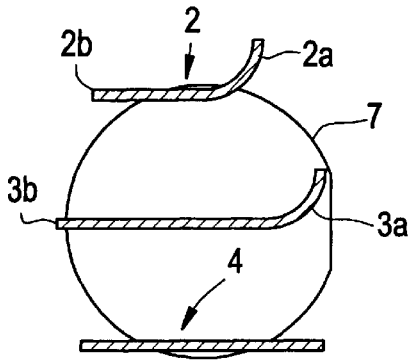
FIG. 2 is a sectional view taken on the line A—A in FIG. 1.
Figure 3:
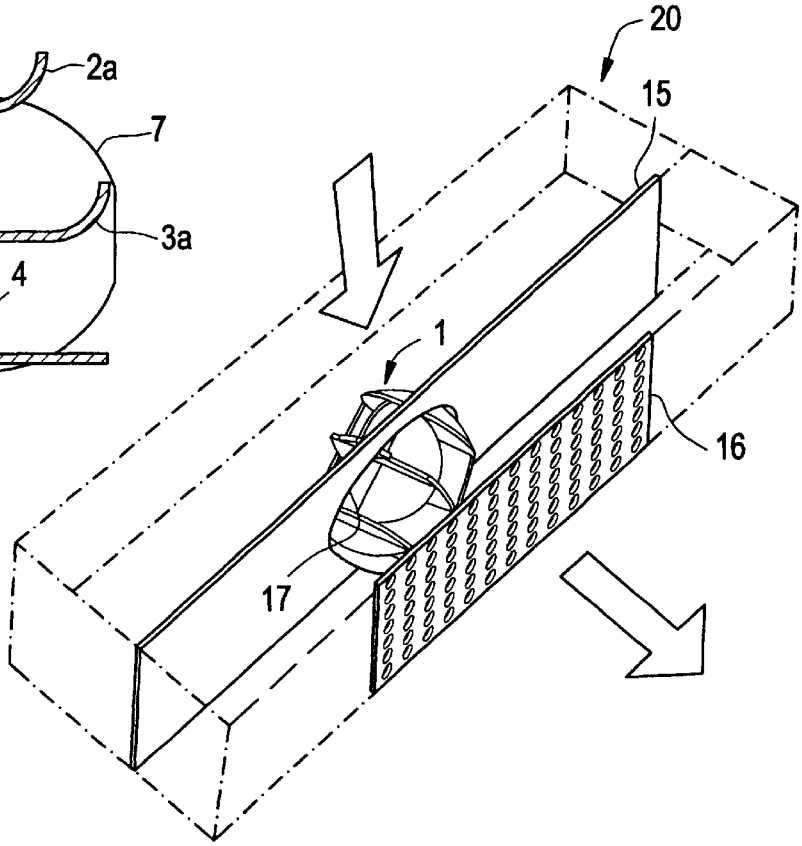
FIG. 3 is a cut-away perspective part view that shows a nozzle in place in a perforated inner wall of an air supply terminal device provided with a perforated outer wall.

Illustrated in FIG. 1 is a nozzle 1 which, as evident from FIG. 3, is accommodated in a hole 17 in a wall 15 of an air supply terminal device 20, that may have any one of a number of configurations. The device 20 may thus have a box-like, screen-like or tubular configuration and, as shown in FIG. 3, may include a body that has a top and a bottom wall and one or more outer walls and/or inner walls that extend between said top and bottom walls. The device is also provided with means (not shown) for delivering an air flow in a main flow direction parallel with the wall 15.

The nozzle is designed to capture and deflect the flow of air that passes through the device. The nozzle 1 is also designed to enable the air flow to exit from the nozzle in two mutually perpendicular directions.

More specifically, the nozzle 1 is provided with two tongues 2, 3 which function as guide vanes or baffles and which both include a rear, curved deflecting part 2*a*, 3*a* and a front, generally flat outflow part 2*b*, 3*b*. The curved deflecting parts 2*a* and 3*a* have mutually different curvatures, which makes the device more favourable from a flow/technical aspect, since the tongues follow the lines of air flow.

The lower tongue 4 lacks a curved deflecting part and does not project out as far into the passing flow, which has been found to result in optimal properties of the device.

The device also includes a central plate-like tongue-holding part 5 which extends perpendicularly to the plane of the outflow parts 2*b*, 3*b*.

The nozzle 1 also includes two circular side walls 7 which are positioned parallel to the central tongue-holding part 5 and spaced at mutually the same distance therefrom, wherein each of the circular side walls is joined to the tongues 2, 3 and 4 in the region of their outer parts.

The nozzle also includes attachment elements for attachment of the nozzle in the hole 17, these attachment elements being constructed to enable the nozzle to be rotated or turned in the hole about a rotational axis that passes through the centre of the hole at right angles to the plane of said hole, and also to be pivoted about a pivot axis which is perpendicular to the rotational axis and which extends in the plane of the hole through the two attachment points.

These attachment elements are generally referenced 6 in FIG. 1 and constitute integral parts of the central tongue-holding part 5 and the ends of said elements are hooked, as shown at 6*a*, for resilient engagement with opposing edge parts of said hole.

The hooks 6*a* thus enable the nozzle to be rotated in the plane of the hole 17 and pivoted—in a selected position of rotation of the nozzle—through an angle of, e.g., 45° in both directions about a pivot axis passing through the two opposing engagement points and falling in the plane of said hole.

The resilient or springy construction of the hooks 6*a* impart enhanced flexibility to the nozzle as a whole. The nozzle can thus be mounted and used even if the shape of the hole should deviate from a round shape, for instance have an oval shape. The nozzle can also be used in cases when the perforated wall is curved.

Disposed on the outside of the nozzle side walls 7 are two arcuate parts 8 that engage the rim of the hole and that each project out at right angles towards respective side walls, said parts 8 functioning to releasably fixate the nozzle in the rotational and pivotal positions to which it has been set. Although not shown, the hole engaging parts 8 may possibly be serrated, toothed, or likewise configured.

The distances between the diametrically opposed engagement points of the hooks 6*a* and the outer points 8*a* of the arcuate hole engaging parts 8 in their respective positions of engagement will thus correspond generally to each other and to the diameter of the hole. In other words, the nozzle has a form which enables it to be embraced and at its four engagement points lie tangential to a sphere whose diameter corresponds to the diameter of said hole.

These latter characteristic features are instrumental in enabling the inventive nozzle to be readily mounted and adjusted. The nozzle will also be held securely fixated in its set position until the nozzle shall be re-positioned.

The fact that the nozzle lacks a surrounding, tubular outer wall represents considerable saving in material. The hole can be said to serve as an outer wall instead.

It has been said in the aforegoing that the nozzle of the illustrated embodiment can be pivoted or swung through 45° in both directions from a starting position. This angle may be smaller or larger than that stated. although it will preferably be equal to at least 30° and suitably not too much larger than 60°, since so-called Coanda effects that occur at larger pivot angles will undesirably impair the flow characteristics of the nozzle The axis about which the nozzle can be pivoted need not necessarily fall in the plane of the hole, but may be displaced relative to said plane. The axis, however, will preferably fall in a plane that is parallel with the plane of the hole.

FIG. 3 shows a nozzle 1 according to FIG. 1 where a hole 17 is provided in a wall 15 in the interior of a air supply device 20 that includes a perforated outer wall 16, of which a part is shown in the figure. Several nozzles 1 can be mounted in the wall. The distance to the perforated outer wall—which may be flat or curved—can vary.

A nozzle according to the invention and a air supply device provided with one or more such nozzles can be varied in different ways within the scope of the accompanying Claims.

What is claimed is:

1. A nozzle for an air supply device for capturing and deflecting an air flow passing through the device, wherein the nozzle (1) is accommodated in a hole (17) in a wall (15) of the device in a manner to enable the nozzle to be rotated about a first axis passing through the center of the hole and extending generally at a right angle to the plane of the hole, thereby allowing the direction in which the air flow leaves the nozzle to be determined, wherein the nozzle (1) includes two or more tongues (2, 3) that have a rear, curved deflecting part (2*a*, 3*a*) and a front outflow part (2*b*, 3*b*), wherein the nozzle (1) is pivotal about a second axis which is perpendicular to the first axis in one of the plane of the hole and a plane which is essentially parallel with the plane of the hole, and wherein the nozzle (1) includes a central tongue-holding part (5) which extends perpendicular to the plane of the outflow parts (2*b*, 3*b*), and two opposing attachment elements (6) for engagement with opposing parts of an edge of the hole in the wall (15).

2. A nozzle according to claim 1, wherein the attachment elements (6) are constructed so that the nozzle can be pivoted from a starting position through an angle of at least 30° in both directions about the second axis through the medium of engagement points that are defined between the two attachment elements and the edge of the hole, regardless of the position to which the nozzle has been rotated.

3. A nozzle according to claim 2, wherein the attachment elements (6) include hooks (6*a*) which springingly engage the edge of the hole (17).

4. A nozzle according to claim 3, wherein the hooks (6*a*) are located in the same plane as the central tongue-holding part (5).

5. A nozzle according to claim 1, wherein the nozzle (1) includes two approximately circular side walls (7) which extend parallel with the central tongue-holding part (5) and spaced equidistantly therefrom, and each of which is joined to the tongues (2, 3).

6. A nozzle according to claim 5, wherein the outer surface of the side walls (7) carries arcuate parts (8) that engage the edge of the hole, and that project out from the side walls (7), and that releasably fixate the nozzle (1) in a set position to which the nozzle has been rotated and pivoted.

7. A nozzle according to claim 6, wherein (a) a first distance between engagement points that are defined between the two attachment elements and the edge of the hole, and (b) a second distance between engagement points that are defined between the arcuate parts (8) and the edge of the hole are substantially equal to a diameter of the hole.

8. An air supply device comprising a body that includes a plurality of walls, and means for supplying an air flow in a main flow direction that is parallel with one of the walls (15), wherein the one wall (15) includes at least one hole (17) that accommodates a nozzle (1), wherein the nozzle (1) is accommodated in the hole (17) in the wall (15) of the device in such a manner to enable the nozzle to be rotated about a first axis passing through the center of the hole and extending generally at a right angle to the plane of the hole, thereby allowing the direction in which the air flow leaves the nozzle to be determined, wherein the nozzle (1) includes two or more tongues (2, 3) that have a rear, curved deflecting part **(2*a*, 3*a*) and a front outflow part (2*b*, 3*b*), and wherein the nozzle (1) is pivotal about a second axis which is perpendicular to the first axis in one of the plane of the hole and a plane which is essentially parallel with the plane of the hole, and further wherein a perforated inner wall (15) accommodates one or more nozzles (1), and an outwardly lying outer wall (16)** of said device is perforated.

* * * * *